United States Patent [19]

Pinneo et al.

[11] 4,413,254

[45] Nov. 1, 1983

[54] COMBINED RADIO AND MAGNETIC ENERGY RESPONSIVE SURVEILLANCE MARKER AND SYSTEM

[75] Inventors: George G. Pinneo, Fort Lauderdale; Jon N. Weaver, Boca Raton, both of Fla.

[73] Assignee: Sensormatic Electronics Corporation, Deerfield Beach, Fla.

[21] Appl. No.: 299,304

[22] Filed: Sep. 4, 1981

[51] Int. Cl.[3] ..... G08B 13/24

[52] U.S. Cl. ..... 340/572; 340/522

[58] Field of Search ..... 340/572, 522, 521

[56] References Cited

U.S. PATENT DOCUMENTS

| | | | |
|---|---|---|---|
| 3,493,955 | 2/1970 | Minasy | 340/572 |
| 3,820,104 | 6/1974 | Fearon | 340/572 |
| 3,895,368 | 7/1975 | Gordon et al. | 340/572 |
| 3,983,552 | 9/1976 | Bakeman, Jr. et al. | 340/572 |
| 4,063,229 | 12/1977 | Welsh et al. | 340/572 |
| 4,195,286 | 3/1980 | Galvin | 340/522 |
| 4,209,776 | 6/1980 | Frederick | 340/522 |
| 4,309,697 | 1/1982 | Weaver | 340/572 |

*Primary Examiner*—Glen R. Swann, III

*Attorney, Agent, or Firm*—Hopgood, Calimafde, Kalil, Blaustein & Judlowe

[57] ABSTRACT

A surveillance marker has a semiconductor connected between arms of a dipole antenna, one arm being of non-ferrous conductive material and the other of high permeability low coercivity material such as permalloy. Higher coercivity magnetizable pieces are disposed adjacent the low coercivity arm, and all is sandwiched between paper or other insulating layers. The marker is detected by a combination of RF field and low frequency magnetic field generating and receiving units that energize a master alarm only when both units simultaneously detect the marker signals. Magnetizing the higher coercivity pieces suppresses a signal that would otherwise be reradiated by the marker from the high permeability arm thereby rendering the marker undetectable.

15 Claims, 12 Drawing Figures

COMBINED RADIO AND MAGNETIC ENERGY RESPONSIVE SURVEILLANCE MARKER AND SYSTEM

BACKGROUND OF THE INVENTION

The present invention relates to markers for surveillance or control and to systems employing the same. Such markers and systems are now used extensively to prevent shoplifting and similar unauthorized removal of articles from a controlled area.

The known marker systems tend to fall into one or the other of two general categories. One category makes use of radio frequency signals, usually in the microwave range, and is typified by the system disclosed in U.S. Pat. No. 4,063,229, issued on Dec. 13, 1977, to John Welsh and Richard N. Vaughan for "Article Surveillance." There is described therein a system wherein sensor-emitter labels or tags containing a semiconductor diode or the like are applied to articles for the purpose of surveillance. Said patent also describes the construction of special tags containing layers of ferrite material that can be magnetized or demagnetized by a suitable magnetic field for altering the operating characteristic of the tag and thereby deactivating the same.

An improved RF system, one that combines a microwave carrier signal with a low frequency signal that is used to establish an electrostatic field, is described in U.S. Pat. No. 3,895,368, issued July 15, 1975, to Lloyd L. Gordon and Robert D. Williamson for "Surveillance System and Method Utilizing Both Electrostatic and Electromagnetic Fields."

The second category makes use of electromagnetic fields inductively coupled to the marker which contains a high permeability low coercivity material having the ability of producing detectable harmonic frequencies when immersed in an alternating magnetic field of sufficient intensity. A refined system falling into this second category is described in copending United States patent application Ser. No. 193,038, filed on Oct. 2, 1980 by Jon N. Weaver for "Magnetic Surveillance System With Odd-Even Harmonic and Phase Discrimination," now U.S. Pat. No. 4,309,697, issued Jan. 5, 1982. Said Weaver patent also contains a good revue of the prior work in the area of this category. The above-mentioned patents are assigned to the same assignee as the present invention and application.

One of the patents mentioned in said Weaver patent is that of Bakeman, Jr. et al., U.S. Pat. No. 3,983,552, issued Sept. 28, 1976. There is disclosed therein a pilferage deterrent marker of laminated construction containing an easily magnetized layer of Permalloy and a control layer of difficult to magnetize vicalloy of remendur. Such marker, when the control layer is magnetized, is detected by a circuit responding to the amplitude and phase of the received second harmonic signal. When the control layer is demagnetized the marker is permitted to pass undetected.

A reverse deactivation arrangement wherein the marker is detected only when demagnetized is described in U.S. Pat. No. 3,820,104, issued on June 25, 1974, to Edward R. Fearon for "Methods and System for Detecting an Object Within A Magnetic Field Interrogation Zone." The abstract in said patent describes the marker as including a first elongated ferromagnetic element for being secured to the object. The first ferromagnetic element has a relatively low coercivity and is operable to generate a detectable signal containing harmonics of the fundamental frequency when placed in the interrogation zone. The marker further includes a second ferromagnetic element disposed adjacent to the first element and having a coercivity greater than the first element. Deactivation structure is provided to selectively magnetize the second ferromagnetic element to impose a plurality of pairs of alternate magnetic poles on the first element in order to deactivate the marker. The deactivated marker does not generate a detectable signal containing the desired harmonics when the object passes through the interrogation zone.

An analysis of the development history of both categories of marker systems reveals a continuing effort to improve sensitivity while reducing false alarms due to triggering of the detection equipment by components other than the markers for which the system was designed. Early RF systems were triggered by transistor radios, an obvious potential problem because of the diodes and other non-linear devices normally incorporated therein, and by the less obvious such as a baby carriage with a rusty oxidic junction therein. Comparable problems have also confronted the magnetic systems.

SUMMARY OF THE INVENTION

With the foregoing in mind, it is the aim of the present invention to provide a marker and system with greater reliability and increased versatility. In effect, the present invention makes use of the best of both worlds.

In accordance with one aspect of the present invention there is provided a marker comprising in combination first passive means including at least one conductive antenna element and being responsive to the energy in a field of radio waves when immersed therein for reradiating a portion of said energy as a detectable and distinguishable radio signal, and second passive means including at least one body of high permeability and low coercivity material and being responsive to the energy in a field of low frequency electromagnetic waves when immersed therein for reradiating a separately detectable signal, both said passive means being united in a common tag structure with said antenna element and said body of high permeability material interrelated for independent electrical operation in spite of electromagnetic coupling therebetween.

In accordance with another aspect of the present invention there is provided a system including the foregoing marker which system is characterized by an RF transmitter and receiver connected to electromagnetic energy radiating and receiving means for establishing in a surveillance zone a field of radio waves and for detecting any radio signal in said zone from said marker, an electromagnetic low frequency transmitter and receiver connected to magnetic field generating and receiving means for establishing in said zone an electromagnetic field of low frequency and for detecting said separately detectable signal from said marker whenever said detectable signal is present in said zone, and means for providing a signal responsive to simultaneous detection in said zone of said radio signal and said separately detectable signal from said marker.

BRIEF DESCRIPTION OF THE DRAWINGS

The invention will be better understood after reading the following detailed description of the presently preferred embodiments thereof with reference to the appended drawings in which.

The same reference numerals are used throughout the drawings to designate the same or similar parts.

DESCRIPTION OF THE PREFERRED EMBODIMENTS

Figure 1:
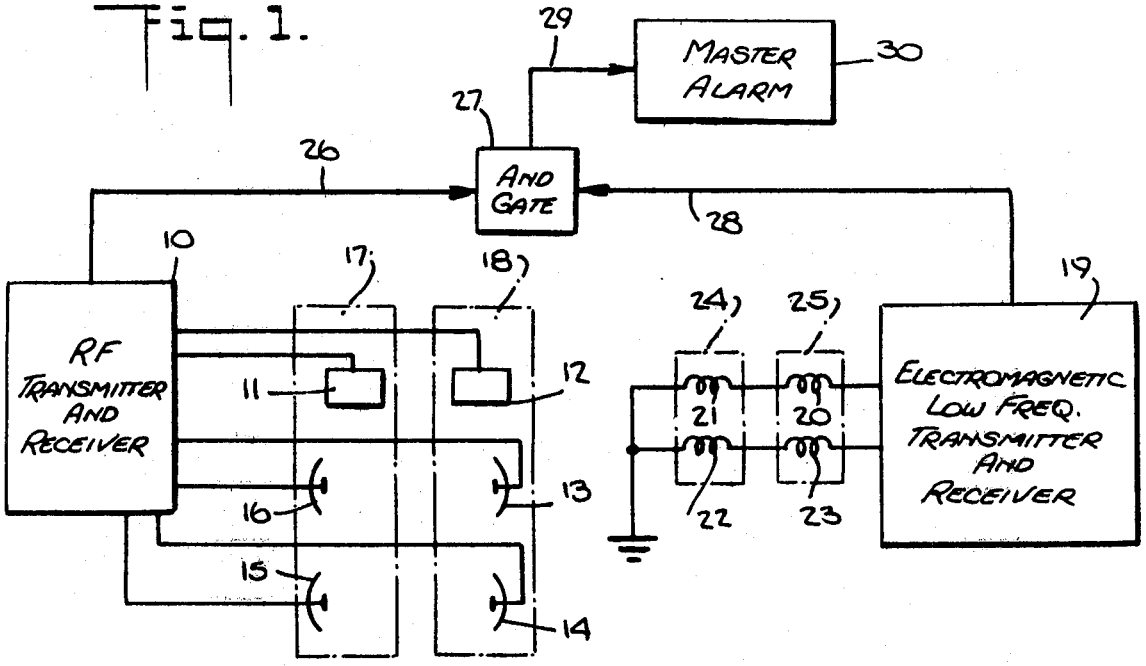
FIG. 1 is a schematic block diagram of a system implementing the present invention.
Figure 4:
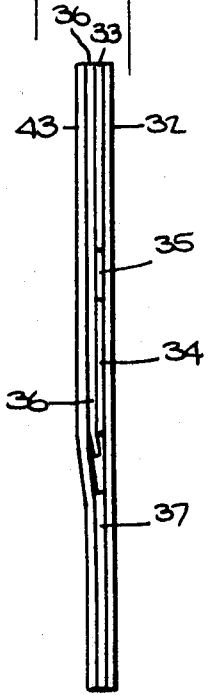
FIG. 4 is a side view of the marker of FIG. 3 as seen from the right side.
Figure 5:
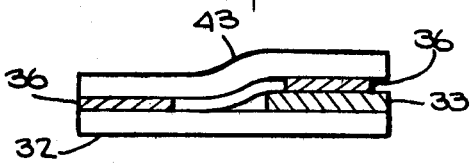
FIG. 5 is a transverse sectional view taken along the line 5—5 in FIG. 3.
Figure 6:
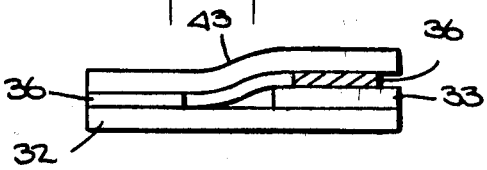
FIG. 6 is a transverse sectional view taken along the line 6—6 in FIG. 3.
Figure 7:
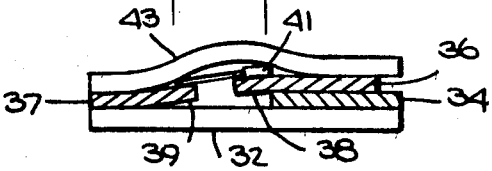
FIG. 7 is a transverse sectional view taken along the line 7—7 in FIG. 3.

Referring now to FIG. 1 there is shown therein designated generally by the reference numeral 10 an RF transmitter and receiver connected to foil elements 11 and 12 and microwave antenna elements 13, 14, 15 and 16 mounted in two pedestal structures shown diagrammatically by the phantom boxes 17 and 18. Merely by way of example, the transmitter and receiver 10 may be implemented by the circuit described with reference to FIG. 4 of said Gordon and Williamson patent identified above.

The circuit of FIG. 1 also includes an electromagnetic low frequency transmitter and receiver 19 connected to a series of windings 20, 21, 22 and 23 mounted in two panels 24 and 25. The construction of the transmitter and receiver 19 with windings 20 through 23 can be as disclosed in the Weaver patent identified above.

Because the details in construction of the transmitter receiver devices 10 and 19 form no part of the present invention, and because they are fully disclosed in the referenced patents, no further discussion is deemed necessary herein. Reference to said documents should be had if further description is desired.

As described in the referenced documents, a signal is provided in each system from a detection circuit to a respective alarm circuit. In accordance with the present invention the connection within the RF transmitter and receiver 10 between its detection circuit and independent alarm (not shown) is tapped and brought out as an output over lead 26 to one input of an AND gate 27. Similarly, the connection within electromagnetic transmitter and receiver 19 between its detection circuit and independent alarm (not shown) is tapped and brought out as an output over lead 28 to a second input to the AND gate 27. The output from AND gate 27 is coupled over lead 29 to a master alarm 30.

When operating, the circuit of FIG. 1 requires both devices 10 and 19 to provide a positive signal to AND gate 27 in order that the latter activate the master alarm 30. If either one of the signals over leads 26 and 28 from the respective devices 10 and 19 is absent, the master alarm 30 will remain inactive. However, if the respective devices 10 and 19 are provided with their independent alarms (not shown) then each respective alarm will be independently actuated when the associated receiver detects a signal from a marker of the type with which it has been designed to operate.

Figure 2:
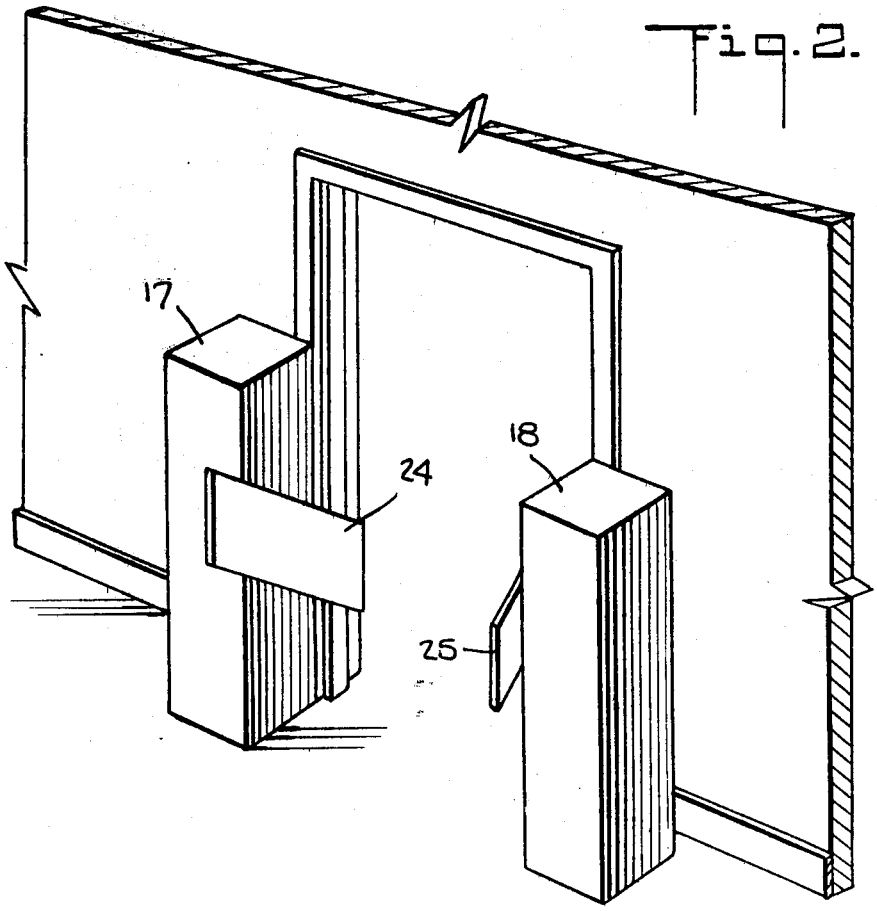
FIG. 2 is a perspective view of a doorway provided with surveillance equipment as illustrated schematically in FIG. 1.
Figure 3:
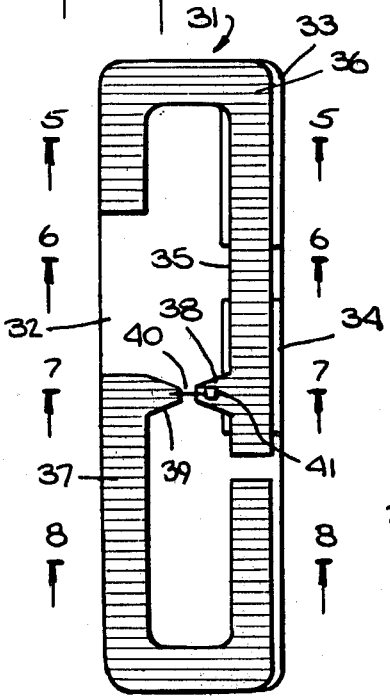
FIG. 3 is a plan view, with the covering layer removed, of a marker constructed in accordance with the present invention.

Referring to FIG. 2, a typical installation is shown of the system described with reference to FIG. 1. Thus the pedestals 17 and 18 will house the elements 10 to 16, inclusive while the panels 24 and 25 will house the coils 20 to 23, inclusive. The component 19 may be housed in one of the pedestals 17 or 18. The AND gate 27 and master alarm 30 may be suitably located either in the pedestals or externally thereto.

Reference now should be had to FIGS. 3 to 9 wherein there is illustrated a marker incorporating the present invention. As seen therein the marker is in the form of a tag structure 31 having a paper or other insulating substrate 32 on which is mounted, by bonding, two rectangular strips of magnetic material 33 and 34 with a gap 35 therebetween, and over which is placed one generally J-shaped conductive antenna element 36 which with a complemental antenna element 37 constitutes a dipole antenna. The elements 36 and 37 are provided with respective wings 38 and 39 facing each other with a small gap 40 therebetween across which is connected a diode consisting of a semiconductor chip 41 and a lead 42, best seen in FIG. 9. The chip 41 is bonded in known manner to the wings 38 while the lead 42 is connected in known manner to the wing 39. The diode and its lead may be encapsulated in a suitable epoxy or other potting medium not shown. Finally, a cover layer of paper or other insulating material is applied at 43 in order to protect and enclose the entire structure. The cover layer 43 has been omitted from FIG. 3 in order to reveal the details of the interior of the tag 31. Moreover, the sectional views shown in FIGS. 5 to 8 have been greatly enlarged and exaggerated for clarity of illustration. The actual layers of material, particularly the metallic elements, will be extremely thin measuring only a few mils in thickness.

In a presently preferred embodiment of tag 31 the antenna element 37 may be formed from aluminum foil while the antenna element 36 may be formed from a high permeability and low coercivity material such as that known as "Permalloy". The elements 33 and 34 should consist of pieces of magnetic material of high coercivity than the material in element 36. Carbon steel has been found satisfactory for this purpose. The wire 42 may be of aluminum of one mil diameter.

Figure 10:
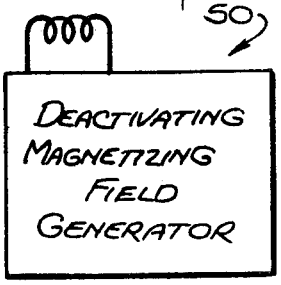
FIG. 10 is a block diagram of a deactivating device in accordance with the subject invention.

It has been found that materials such as Permalloy have sufficient conductivity that they can function as antenna elements for the RF energy involved in the RF systems while at the same time can produce the necessary harmonics when exposed to the low frequency electromagnetic field for operating in that type of system. However, in the present structure the harmonics for operation of the low frequency system are produced only when the magnetic pieces 33 and 34 remain demagnetized. If pieces 33 and 34 are magnetized by exposing them to a magnetizing field from a suitable source such as the deactivating magnetizing field generator and coil assembly 50 shown in FIG. 10, tag 31 will fail to activate the transmitter receiver 19 of FIG. 1 to produce an alarm signal. Hence, neither the local alarm signal (when present) nor the master alarm 30 will be actuated.

Figure 11:
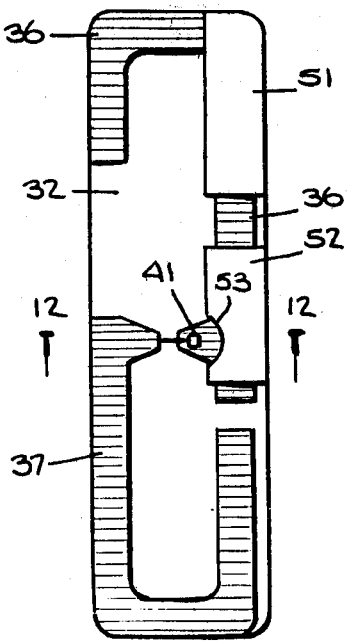
FIG. 11 is a view similar to FIG. 3 but showing a modification thereof.
Figure 8:
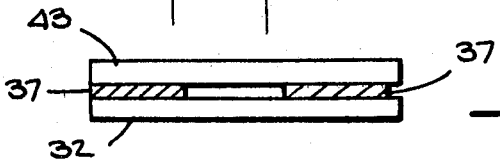
FIG. 8 is a transverse sectional view taken along the line 8—8 in FIG. 3.
Figure 9:
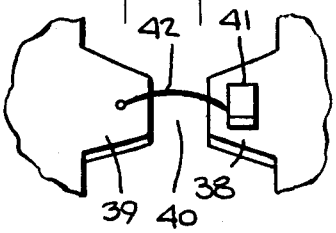
FIG. 9 is an enlarged fragmentary perspective view of a portion of the marker of FIG. 3 illustrating a detail thereof.
Figure 12:
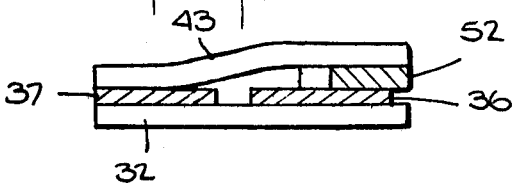
FIG. 12 is a transverse sectional view taken along the line 12—12 in FIG. 11.

FIGS. 11 and 12 illustrate a modification of the tag construction wherein the antenna elements 36 and 37 are now located both immediately adjacent the substrate 32 while the pieces of high coercivity magnetic material 51 and 52 are located on top of antenna element 36, as shown. A notch 53 may be cut in the edge of piece 52 in order to clear the semiconductor chip 41. The advantage of the embodiment of FIGS. 11 and 12 over that of FIGS. 3 through 8 is that it provides a somewhat smoother surface to which the covering insulating layer 43 may be applied. This embodiment may also be slightly easier to fabricate then that shown in FIGS. 3 to 8.

Some of the advantages flowing from the subject invention should now be evident. Providing a combined tag that requires both the diode characteristic as well as the high permeability magnetic characteristic to occur simultaneously before an alarm is actuated insures to a greater degree against false actuation. The tags can be readily activated or deactivated by magnetization or demagnetization, as desired. Thus, the subject tags can be used interchangeably in expendable and nonexpendable operations. In fact, for lower levels of security it is possible to use the same tags as described herein with either the RF system or the low frequency electromagnetic system operating independently.

Having described the presently preferred embodiments of the subject invention, it should be apparent to those skilled in the subject art that various changes in construction can be incorporated without departing from the true spirit of the invention as defined in the appended claims.

What is claimed is:

1. A marker comprising in combination first passive means including at least one conductive antenna element and being responsive to the energy in a field of radio waves when immersed therein for reradiating a portion of said energy as a detectable and distinguishable radio signal, and second passive means including at least one body of high permeability and low coercivity material and being responsive to the energy in a field of low frequency electromagnetic waves when immersed therein for reradiating a separately detectable signal, both said passive means being united in a common tag structure with said antenna element and said body of high permeability material interrelated for independent electrical operation in spite of electromagnetic coupling therebetween.

2. A marker according to claim 1, characterized in that said antenna element and said body constitute a common structural element.

3. A marker according to claim 2, characterized in that said common structural element comprises a ribbon-like structure of high permeability low coercivity material shaped and dimensioned to function both as an antenna for radio frequency waves and as a harmonic generator for low frequency magnetic waves.

4. A marker according to claim 3, characterized in that said passive means are laminated within said tag structure.

5. A marker according to claim 1, characterized in that said antenna element comprises a ribbon-like structure of high permeability low coercivity material shaped and dimensioned to function both as an antenna for radio frequency waves and as said body of high permeability material.

6. A marker comprising in combination a non-linear impedance element connected to at least one conductive antenna element, and a body of high permeability and low coercivity material dimensioned and configured to reradiate a separately detectable signal when immersed in a low frequency electromagnetic field, said body being electrically connected to said impedance element so as to constitute another conductive antenna element, said impedance element with its connected antenna elements being responsive to the energy in a field of radio waves when immersed therein for reradiating a portion of said energy as a detectable and distinguishable radio signal, said elements and body being united in a single structure.

7. A marker according to claim 6, characterized in that said one conductive antenna element consists of a ribbon-like structure of non-ferrous material that cooperates with said body, also ribbon-like, as a dipole antenna for said impedance element.

8. A marker according to claim 6, characterized in that pieces of higher coercivity magnetic material are disposed adjacent said body of high permeability material for altering in a detectable and distinguishable manner the signal reradiating character of said body when said pieces of magnetic material are magnetized.

9. A marker according to claim 8, characterized in that said one conductive antenna element consists of a ribbon-like structure of non-ferrous material that cooperates with said body, also ribbon-like, as a dipole antenna for said impedance element.

10. A marker comprising in combination of non-linear impedance element connected to a body of high permeability and low coercivity material, the latter being dimensioned and configured to reradiate a separately detectable signal when immersed in a low frequency electromagnetic field and simultaneously to constitute a conductive antenna element which is combination with said impedance element responds to the energy in a field of radio waves when immersed therein for reradiating a portion of said energy as a detectable and distinguishable radio signal, said elements and body being united in a single structure.

11. A system including a marker according to claim 10, characterized by an RF transmitter and receiver connected to electromagnetic energy radiating and receiving means for establishing in a surveillance zone a field of radio waves and for detecting any radio signal in said zone from said marker, an electromagnetic low frequency transmitter and receiver connected to magnetic field generating and receiving means for establishing in said zone an electromagnetic field of low frequency and for detecting said separately detectable signal from said marker whenever said detectable signal is present in said zone, and means for providing a signal responsive to simultaneous detection in said zone of said radio signal and said separately detectable signal from said marker.

12. A system according to claim 11, further characterized in that at least one of said receivers is provided with an independent signalling device for providing an indication whenever such receiver detects the signal that it was constructed to receive.

13. A marker according to claim 10, characterized in that pieces of high coercivity magnetic material are disposed adjacent said body of high permeability material for altering in a detectable and distinguishable manner the signal reradiating character of said body when said pieces of magnetic material are magnetized.

14. A system including a marker according to claim 13, characterized by an RF transmitter and receiver connected to electromagnetic energy radiating and receiving means for establishing in a surveillance zone a field of radio waves and for detecting any radio signal in said zone from said marker, an electromagnetic low frequency transmitter and receiver connected to magnetic field generating and receiving means for establishing in said zone an electromagnetic field of low frequency and for detecting said separately detectable signal from said marker whenever said detectable signal is present in said zone, and means for providing a signal responsive to simultaneous detection in said zone of said radio signal and said separately detectable signal from said marker.

15. A system according to claim 14 further characterized in that means are provided for selectably changing the state of said means for altering the signal reradiating character of said second passive means to render said marker undetectable by said low frequency receiver.

* * * * *